United States Patent [19]

Morrison

[11] Patent Number: 4,753,369

[45] Date of Patent: Jun. 28, 1988

[54] NAPKIN DISPENSER

[75] Inventor: Howard J. Morrison, Deerfield, Ill.

[73] Assignee: Marvin Glass & Associates, Chicago, Ill.

[21] Appl. No.: 812,959

[22] Filed: Dec. 24, 1985

[51] Int. Cl.[4] ..... A47G 21/16

[52] U.S. Cl. ..... 221/56; 211/51; 211/593; 248/154; 248/504; 312/61

[58] Field of Search ..... 221/56–62, 221/33; 312/42, 50, 60–61, 71, 188, 193; 211/59.3, 59.2, 51–52; 248/DIG. 5, 504, 154; D7/72

[56] References Cited

U.S. PATENT DOCUMENTS

| | | | |
|---|---|---|---|
| 962,676 | 6/1910 | Snyder | 211/51 |
| 1,477,100 | 12/1923 | Binns et al. | 248/504 |
| 1,579,135 | 3/1926 | Olson | 248/504 X |
| 1,583,293 | 5/1926 | Horwitt | 211/51 |
| 1,805,761 | 5/1931 | Pamphlis | 211/51 |
| 2,202,300 | 5/1940 | Posnack | 211/51 |
| 3,709,763 | 1/1973 | O'Neil | 221/33 X |
| 4,132,329 | 1/1979 | Harrison | 221/155 X |

FOREIGN PATENT DOCUMENTS

| | | | |
|---|---|---|---|
| 1037936 | 9/1953 | France | 221/33 |
| 2380895 | 9/1978 | France | 211/51 |
| 114282 | 6/1945 | Sweden | 312/50 |

*Primary Examiner*—Charles A. Marmor
*Attorney, Agent, or Firm*—John S. Pacocha

[57] ABSTRACT

A dispenser for paper napkins including a container having a substantially open top and front. Opposed side walls of the container receive a cover that can pivot about an axis adjacent the rearward edges of the cover. In addition to pivotal movement, the cover is also mounted for up and down sliding movement to better accommodate various numbers of napkins. Angling the forward edges of the cover downwardly toward the stack of napkins concentrates the pressure exerted on the stack across a line inward of the front of the container. The cover is pressed down on the stack causing the ends of the napkins to fan apart facilitating the user grasping and removing any desired number of the napkins.

1 Claim, 1 Drawing Sheet

NAPKIN DISPENSER

BACKGROUND OF THE INVENTION

1. Field of the Invention

This invention relates generally to napkin dispensers and more particularly to a dispenser facilitating user selection of the number of napkins to be dispensed.

2. Background Art

Folded paper napkins have become commonplace items in both the home and in public eating establishments. Dispensers into which prefolded paper napkins are loaded under spring pressure or the like and which tend to limit customer extraction of the napkins to one at a time have long been in use in public eating establishments. However, there remains a need for a dispenser for paper napkins, particularly in the home, that will provide a container for a supply of such napkins and facilitate the grasping or dispensing of from one to a relatively large plural number of the napkins.

SUMMARY OF THE INVENTION

The present invention is concerned with providing a napkin dispenser that stores a supply of paper or other flexible material napkins and that facilitates the dispensing or grasping of a user selected number of such napkins. These and other objects and advantages of the invention are achieved with a container including a bottom, a back, and spaced apart sidewalls with a substantially open top and front. A cover having a rearward and a forward edge is mounted on the container with the forward edge inside the front of the container and to permit pivotal movement of the cover about an axis adjacent the rearward edge of the cover and parallel to the back wall of the container. Performance of the dispenser is improved by also providing for vertical movement of the entire cover, including the axis, relative to the bottom of the container. Vertical recesses or slots formed on the inside of each of the two opposed sidewalls receive a cylindrical projection extending outwardly from each side of the cover along the pivotal axis. A downward curve or angle at the forward edge of the cove helps concentrate pressure exerted by the cover upon an underlying supply of napkins. In use, a stack of napkins is placed in the container with the creased or folded end of the napkins extending out the open front. The cover is then lowered and permitted to rest upon the stack of napkins. When the user presses down adjacent the forward edge of the cover, additional pressure is exerted on the stack of napkins across a line extending substantially between the opposed sidewalls inward of the creases or folded ends of the napkins. Such pressure compresses the stack along that line and fans apart the folded ends to facilitate the user counting out and grasping the desired number of napkins for use in setting the table or the like.

BRIEF DESCRIPTION OF THE DRAWINGS

For a better understanding of the present invention reference may be had to the accompanying drawings in which.

DETAILED DESCRIPTION OF THE PREFERRED EMBODIMENT

Figure 1:
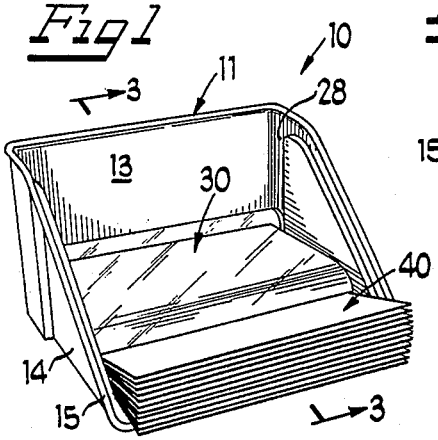
FIG. 1 is a perspective view of an embodiment of the present invention in a quiescent state.

Referring now to the drawings in which like parts are designated by like reference characters throughout the several views, there is shown in FIG. 1 a napkin dispenser 10. A container 11 is formed of an integrally molded piece having a bottom wall 12, a back wall 13, and a pair of spaced apart opposed sidewalls 14. Each of the sidewalls angles down from adjacent the back wall to the front of the bottom leaving a substantially open top and front. Around the entire periphery of the container formed by the top of the back wall 13, the angled edge of the each of the sidewalls 14 and the front edge of the bottom wall 12 is a continuous bead 15 which defines the substantially open top and front of the container and protects against any sharp edges coming into contact with the user's hand.

Figure 3:
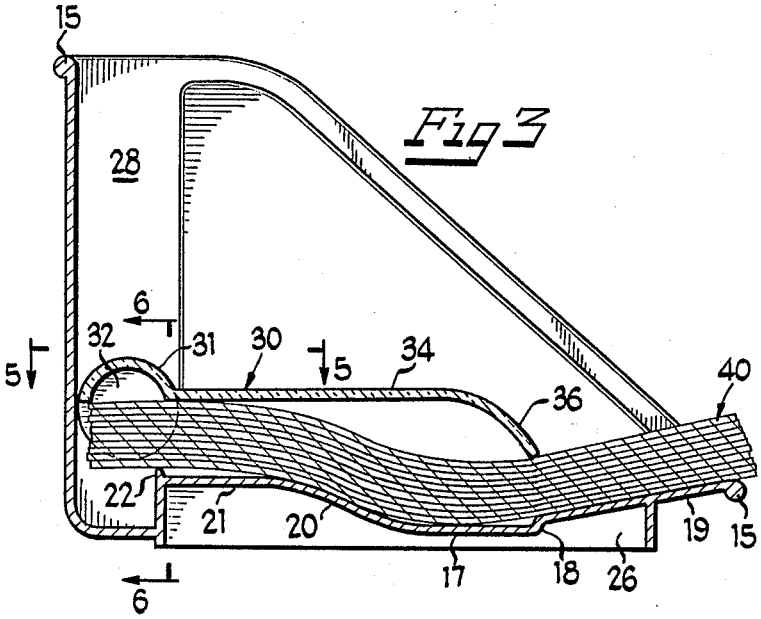
FIG. 3 is an enlarged, sectional view taken generally along line 3—3 of FIG. 1.
Figure 4:
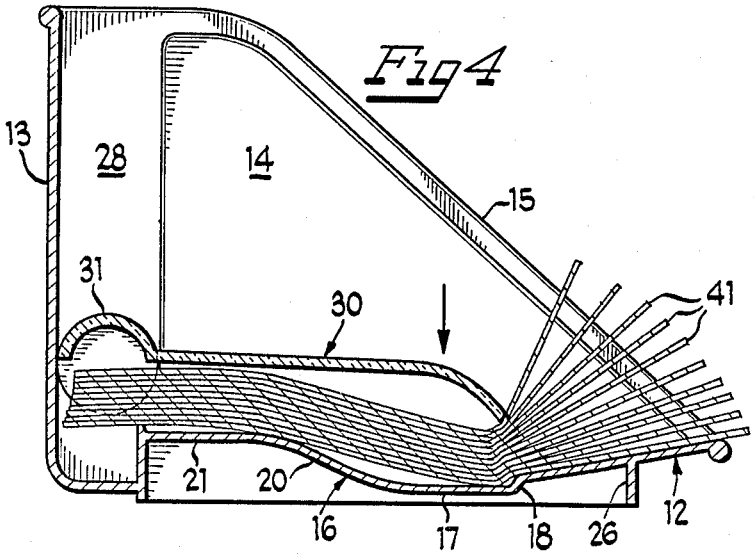
FIG. 4 is an enlarged, sectional view taken generally along line 4—4 of FIG. 2.
Figure 5:
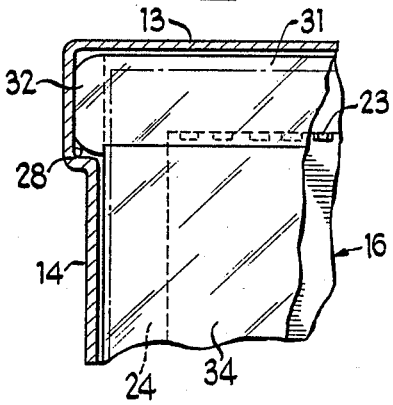
FIG. 5 is a sectional view of a portion taken generally along line 5—5 of FIG. 3.
Figure 6:
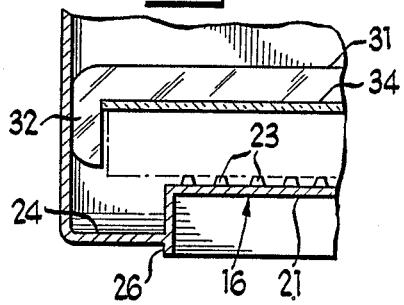
FIG. 6 is a sectional view of a portion taken generally along line 6—6 of FIG. 3.

As is best shown in FIGS. 3 and 4, the contour of the central part 16 of bottom wall 12 between sidewalls 14 is such that there is a depressed portion 17 between the front edge and the back wall. Depression 17 rises up sharply toward the front to meet, at intermediate edge 18, a section 19 sloping gently upwardly from the depression to the front edge defined by bead 15. A backwardly and upwardly curving portion 20 extends from the depression to a generally horizontally disposed portion 21 terminating at rear raised serrated knife edge 22 which is the highest point of the bottom wall. Serrated knife edge 22 has a plurality of teeth 23. Along each side of central part 16 is a lateral trough 24.

Beneath bottom wall 12 is a base 26, the bottom of which defines a generally planar surface for positioning container 11 upon a table, countertop or the like. Base 26 has its forwardmost wall inboard of the front of the container to space the front of bottom wall 12 of the container from the table or other supporting surface.

On the inside surface of each sidewall 14, between the junction of the sidewall with back wall 13 and rear raised edge 22 is a generally vertically disposed recess or slot 28. Each of the slots extend from the open top down to below rear raised edge 22. Both slots have essentially the same width.

A cover 30 which may also be integrally molded, and is preferably formed of a transparent material, is received through the open top and front of container 11 for both pivotal and vertical movement. Adjacent its rearward edge, cover 30 has an upper, semicylindrical portion 31. The centerline of portion 31 defines an axis extending across the width of the cover adjacent its rearward edge. At each end, portion 31 has a coaxial cylindrical projection or hub 32 of a diameter slightly less than the width of a slot 28. Each hub 32 is received in a respective one of slots 28 so that the entire cover 30 may pivot about the axis and slide up and down in the slots.

Projecting out from semicylindrical portion 31 is a generally planar part 34 which terminates in a curved downwardly angling front portion 36 defining a free forward edge. The length of cover 30 is such that with the hubs 32 received in slots 28, the forward edge lies about one-third the distance between the rear raised edge and the front edge inside of the front edge of container 11. In addition, the forward edge of cover 30 lies approximately above, though slightly to the rear of intermediate edge 18 so that the forward edge of the cover would pass along the inside of the intermediate edge down into depression 17.

In use, a stack of napkins 40 are placed in the container 11, preferably with any folded or creased ends 41 along the front edge. Although the present invention will probably be most often used with paper napkins, there is nothing precluding its use with cloth or other flexible material napkins. The stack of napkins may range from a single napkin to a relatively large number of napkins filling up the container 11. A maximum limit on the number of napkins is established by the height of sidewalls 14 or more particularly, the height of vertical slots 28 above bottom wall 12, since at least the lower half of each of hub 32 should remain in a slot 28.

Figure 2:
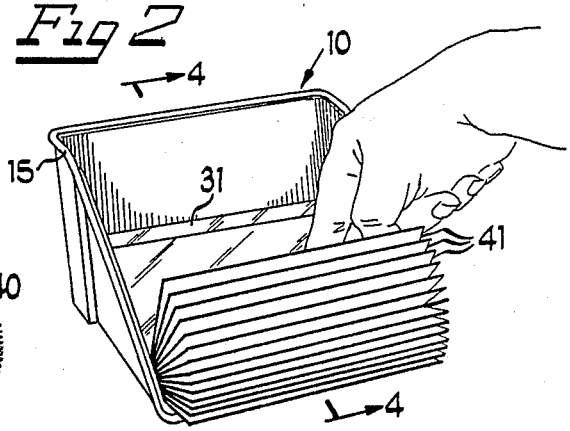
FIG. 2 is a perspective view of the embodiment shown in FIG. 1 in use with pressure being exerted upon the cover by a user's hand.

When a user exerts a downward force upon cover 30, preferably near the downwardly curving part of the cover, as illustrated by the hand in FIG. 2 and the arrow in FIG. 4, the forward edge of the cover concentrates pressure across a line of the napkin stack. The pressure compresses the stack, approximately one-third of the length of the napkin in from the folded ends 41, causing the napkin ends to fan out as illustrated in FIG. 4 thus facilitating the user grasping and removing one or whatever number of such napkins are desired for the setting of a table or the like.

Since, absent pressure from the user's hand, cover 30 is only biased down against the napkins by gravity, it does not prevent removal of the napkins and the user will naturally relax the pressure after grasping the selected number of napkins. However, the gravity bias is sufficient to return the cover to a quiescent position ready for the next use. If the user presses down on the cover with any one or more of the middle, ring, and little fingers, napkins may be grasped and removed from the dispenser with the thumb and forefinger of the same hand. Raised rear serrated knife edge 22 helps to keep the stack aligned and helps to cause outside ends 41 to fan apart rather than for the entire napkin to slide out the front of the container particularly as the number of napkins in the stack decreases.

While a particular embodiment of the present invention has been shown and described, changes and modifications will occur to those skilled in the art. It is intended in the following claims to cover all such changes and modifications as fall within the true spirit and scope of the present invention.

What is claimed as new and desired to be secured by Letters Patent is:

1. A dispenser for flexible material napkins comprising:

a container including a bottom wall, a back wall extending generally upwardly from the bottom wall, and a pair of spaced apart opposed sidewalls;

the container having a substantially open top and a substantially open front;

the bottom wall of the container having a raised edge proximate the back wall, a depression intermediate the raised edge and the front of the container, plus a section angling upwardly adjacent the front of the container;

the depression rising sharply toward the front to meet the section angling upwardly adjacent the front at an intermediate edge;

a cover facilitating exertion of a force downwardly through the substantially open top to concentrate pressure along a line extending between the spaced apart sidewalls upon flexible material napkins positioned between the bottom wall and the cover with ends of the napkins extending beyond the cover to cause the respective ends of the napkins adjacent the cover to separate from one another for user accessibility through the substantially open front;

the cover including a rearward edge and a forward edge with the forward edge lying about one third the distance between the raised edge and the front edge and being angled downwardly toward the bottom wall;

means mounting the cover on the container with the forward edge inside the front of the container and to permit both pivotal movement of the cover about an axis adjacent the rearward edge and extending between the opposed sidewalls generally parallel to and approximate the back wall as well as generally vertical movement of the cover; and the forward edge of the cover lying approximately above, though slightly to the rear of, the intermediate edge such that the forward edge of the cover would pass along the inside of the intermediate edge down into the depression in the absence of any napkins between the bottom wall and the cover.

* * * * *